United States Patent [19]

Juergens

[11] 4,081,043

[45] Mar. 28, 1978

[54] HYDRAULIC JARS FOR BORE HOLE DRILLING

[75] Inventor: Rainer Juergens, Celle, Germany

[73] Assignee: Christensen, Inc., Salt Lake City, Utah

[21] Appl. No.: 762,624

[22] Filed: Jan. 26, 1977

[51] Int. Cl.[2] ..... E21B 1/10

[52] U.S. Cl. ..... 175/297; 175/301

[58] Field of Search ..... 175/296, 297, 301

[56] References Cited

U.S. PATENT DOCUMENTS

| | | | |
|---|---|---|---|
| 2,029,609 | 2/1936 | Burns et al. | 175/301 |
| 2,876,993 | 3/1959 | Hooks | 175/301 |
| 3,406,770 | 10/1968 | Anterbury et al. | 175/301 |
| 3,912,026 | 10/1975 | Crowe et al. | 175/297 |

*Primary Examiner*—James A. Leppink
*Attorney, Agent, or Firm*—Subkow and Kriegel

[57] ABSTRACT

Hydraulic jar apparatus to be disposed in a drilling string used in drilling a well bore or other bore hole, embodying inner and outer telescopically arranged bodies, with a hammer on the inner body adapted to strike an anvil on the outer body, the bodies being initially releasably locked or interconnected in fully telescoped or contracted relation by a locking device which can be released while the apparatus is in the bore hole before the apparatus can function as a jarring device or a bumper sub.

14 Claims, 19 Drawing Figures

200
(m)
190
45
40
30
20
10
304
301
302
300
303

HYDRAULIC JARS FOR BORE HOLE DRILLING

The invention concerns hydraulic jars for deep well drilling which can be installed as a component in a drill pipe string, with an outer pipe body and an inner pipe body defining with the latter an annular space filled with a pressure medium, where the outer pipe body and the inner pipe body are displaceable coaxially relative to each other and are provided with an inner percussion piston acting as a hammer adapted to strike an anvil, when the inner and outer pipe bodies move apart, as well as with end stops for limiting telescopic movement between the inner and outer pipe bodies.

Hydraulic jars of this type are used in deep well drilling as a part of the drilling string, so that the drilling string can be loosened quickly by upwardly or downwardly directed hammer blows when it gets stuck in the borehole. Upwardly directed blows, and also downwardly directed blows, depending on the design of the jars, are produced by a separating movement of inner and outer pipe bodies caused by axial tensile forces introduced into the drilling string, by means of the percussion piston acting as a hammer. As a result of the telescopic movement of the inner and outer pipe bodies, downwardly directed blows, which are produced by limited raising and then lowering of the drill string, can be performed by the jars on the part of the drilling string arranged below the jars. Such hydraulic jars are characterized by a great force of the hammer blow, which is regulatable within wide limits, and which can be adjusted or varied in a simple manner by the operator at the drilling installation above the borehole at any time during the drilling operation, while the jars are in the borehole.

In mechanical jars, on the other hand, the force of the blow must be preset at the drilling installation and can no longer be varied during the operation of the jars in the borehole. Due to the presetting of the load, which causes the upwardly and downwardly directed blows of the mechanical jars, the latter can only be installed in the drilling string at those points where it is substantially free of axial pressures. It is, therefore, limited to installation in the upper end region of the drill stem assembly, for example, directly above the top stabilizer in the drill string, since there is a great risk of accidental release of the jars for a blow, due to the high axial pressure acting on the upper part of the jars, which could result in damage to the drilling bit or other tools in the drill string. On the other hand, however, the preset force of the jars with the usual arrangement in the upper part of the drill stem assembly, is not sufficient in many cases to loosen the drill string when it gets stuck inside the stabilized region of the drill stem assembly. Mechanical jars installed in the upper region of the drill stem assembly, or in the adjoining transition linkage, therefore, can do their job only as a rule if the drill string gets stuck above the stabilized region of the drill stem assembly.

A desirable arrangement of hydraulic jars of the above indicated type, in a range above the drill stem assembly or at a considerable distance above the stabilized region of the drill stem assembly, still involves considerable risks which are caused by the design of the hydraulic jars. When the drill string is lowered into the borehole with such an arrangement of the jars, the great weight of the part of the drill string below the jars causes a relatively rapid separating movement of the inner and outer pipe body of the jars, at the end of which is imposed a vigorous upwardly directed blow. Such a blow represents a hazard for the operating personnel at the drilling installation, particularly when they are not prepared for such a blow. This is very frequently the case, since the jars which are extended during the separating movement of the inner and outer pipe bodies is telescoped when the drilling string is lowered into the borehole, either striking the lower part of the drilling string accidentally on projecting edges or shoulders in the borehole, or by the resistance of liquid contained in the borehole, and exerts a blow subsequently. Such accidental blows represent a particular hazard if the drilling string is caught at the drilling installation in the slips of the rotary table, which can be shifted by such blows out of their holding engagement with the drilling string, and can lead to loss of the entire drilling string when it drops into the borehole. For this reason, hydraulic jars can be used, as a rule, only in the lower part of the drill stem or string assembly, that is, directly above the top stabilizer, an arrangement where the above-mentioned accidental blows do not have the above described far-reaching and dangerous effects, but where the assembly can be jarred loose effectively.

The invention is based on the problem of providing jars of the above-described type which can be installed at any point in the drilling string and is secured against accidental blows until it is brought at a selected time into a state where it is conditioned for imparting a hammer blow.

This problem is solved according to the invention in a manner that the inner pipe body and the outer pipe body are locked, at least in a partly telescoped position, by a locking device against further axial relative separating movement, the locking device being releasable by subjecting the jars to a predetermined axial pull acting between the inner and the outer pipe bodies.

Due to this design, the delivery of jarring blows by the inner and outer pipe bodies moving apart by the necessary amount is positively avoided, until the jars are subjected deliberately by the operating personnel of the drilling installation with a predetermined axial pull, namely, a certain overload, which acts between the inner and outer pipe bodies and thus releases or unlocks the locking device. This is, as a rule, only necessary when the drilling string gets stuck, which happens generally only after it has fully entered the borehole. As long as the drilling string hangs in the slips of the rotary table of the drilling installation, or during its lowering into the borehole, accidental blows are positively prevented from occuring. This provides the possibility of installing jars according to the invention in the drilling string not only in the stabilized region of the drill stem assembly, e.g. directly above the top stabilizer, but at any desired point, for example, in the upper region of the drill stem assembly, or considerably above it. It is, thus, no longer necessary to keep different types of jars in stock, for example, mechanical and hydraulic jars, for different purposes or at different points in the drilling string. During lowering of the drilling string, the locked jars can transmit downwardly directed shocks or blows of the drilling shaft to overcome obstacles, or act as a buffer gear, that is, as a so-called bumper sub, while it performs all functions of ordinary hydraulic hammer jars without limitations in its operating state.

In another development of the invention, the locking device can be formed by one or several parallel safety members connecting the inner pipe body with the outer pipe body, which provide a simple arrangement of locking the inner and outer pipe bodies.

Preferably, however, an additional closed annular space filled with a pressure medium is provided in the upper or lower region of the jars between the inner and the outer pipe bodies, acting as a hydraulic locking device, which is closed at one end by an annular piston, bearing on the inner or outer pipe body at its end face remote from the interior of the annular space, being connected with the surrounding outer pipe body and having at least one pressure relief valve which opens when the pressure medium enclosed in the annular space attains a predetermined overpressure.

This hydraulic locking device permits a partial separating movement of the inner and outer pipe bodies by partially filling the additional annular space with the pressure medium, e.g. up to half the total extension path of the jars, which now permits, by the telescopic movement of the inner and outer pipe bodies, stronger downward blows when the drilling string is lowered into the borehole. In the event the part of the drilling shaft below the jars encounters resistance in the borehole only when the drilling string has been completely lowered into the borehole, and it is necessary to perform upward blows by means of the hydraulic jars during the drilling operation when the drilling string gets stuck, the inner and outer pipe bodies of the jars are extended by applying the predetermined axial pull or overload from the drilling installation at the surface of the well by opening the pressure relief valve, which produces an upward blow by means of the percussion piston or hammer striking the opposite shoulder or anvil.

Other features and advantages of the invention will result from the following description in connection with the drawing, in which several embodiments of the subject of the invention are illustrated.

FIG. 1 shows four views, FIGS. 1*a*, 1*b*, 1*c*, 1*d*, of partial regions of differently composed drilling strings with installed hammer jars in a schematic representation;

FIGS. 2 and 2*a*, 3, 4, 5, 6, and 7 each show an embodiment of hydraulic hammer jars according to the invention in a half axial section;

Figure 6:
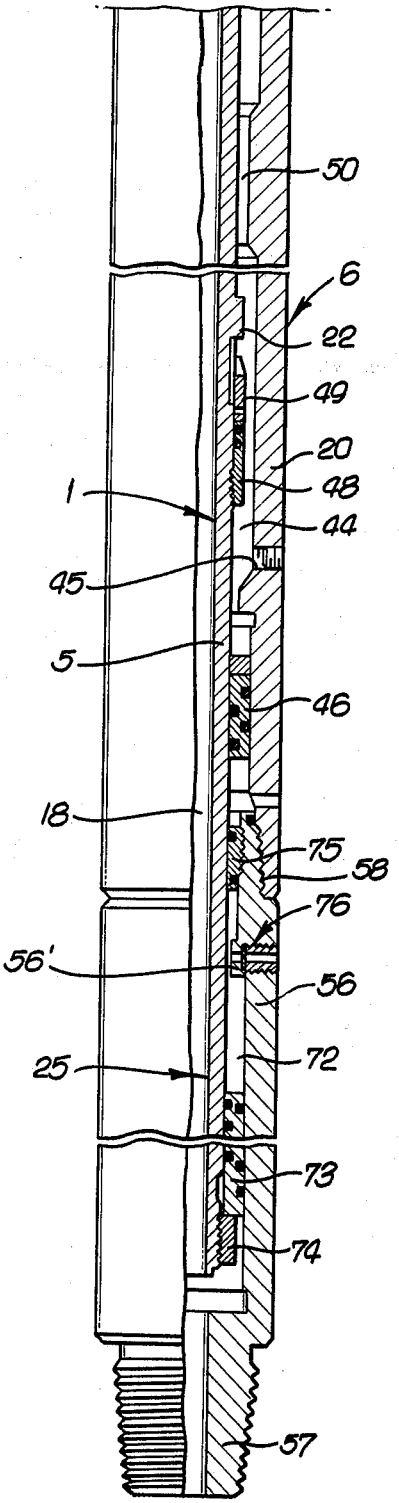
Figure 7:
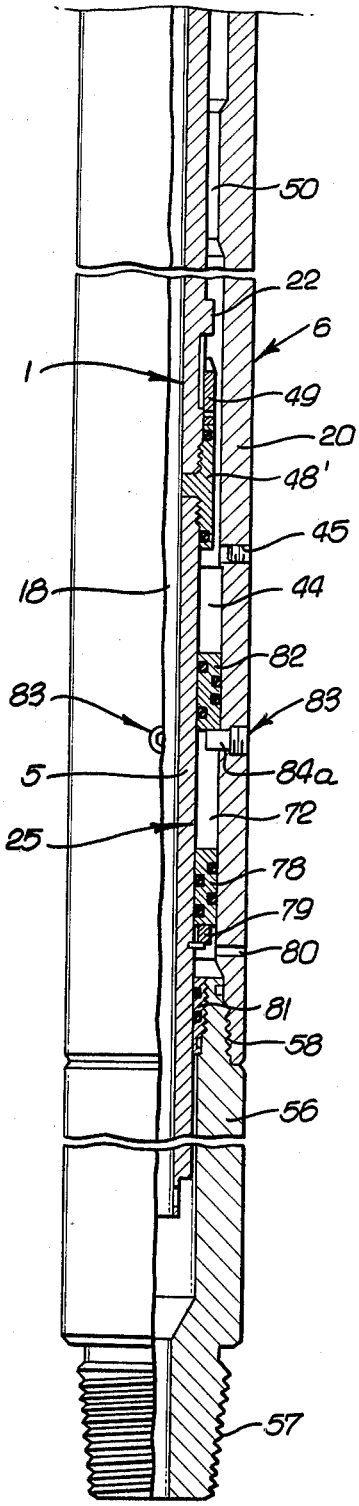

FIGS. 12, 13, 14 and 15 each disclose in axial section an embodiment of a pressure relief valve used in the FIGS. 6 and 7 embodiments.

Figures 1A, 1B, 1C, 1D:
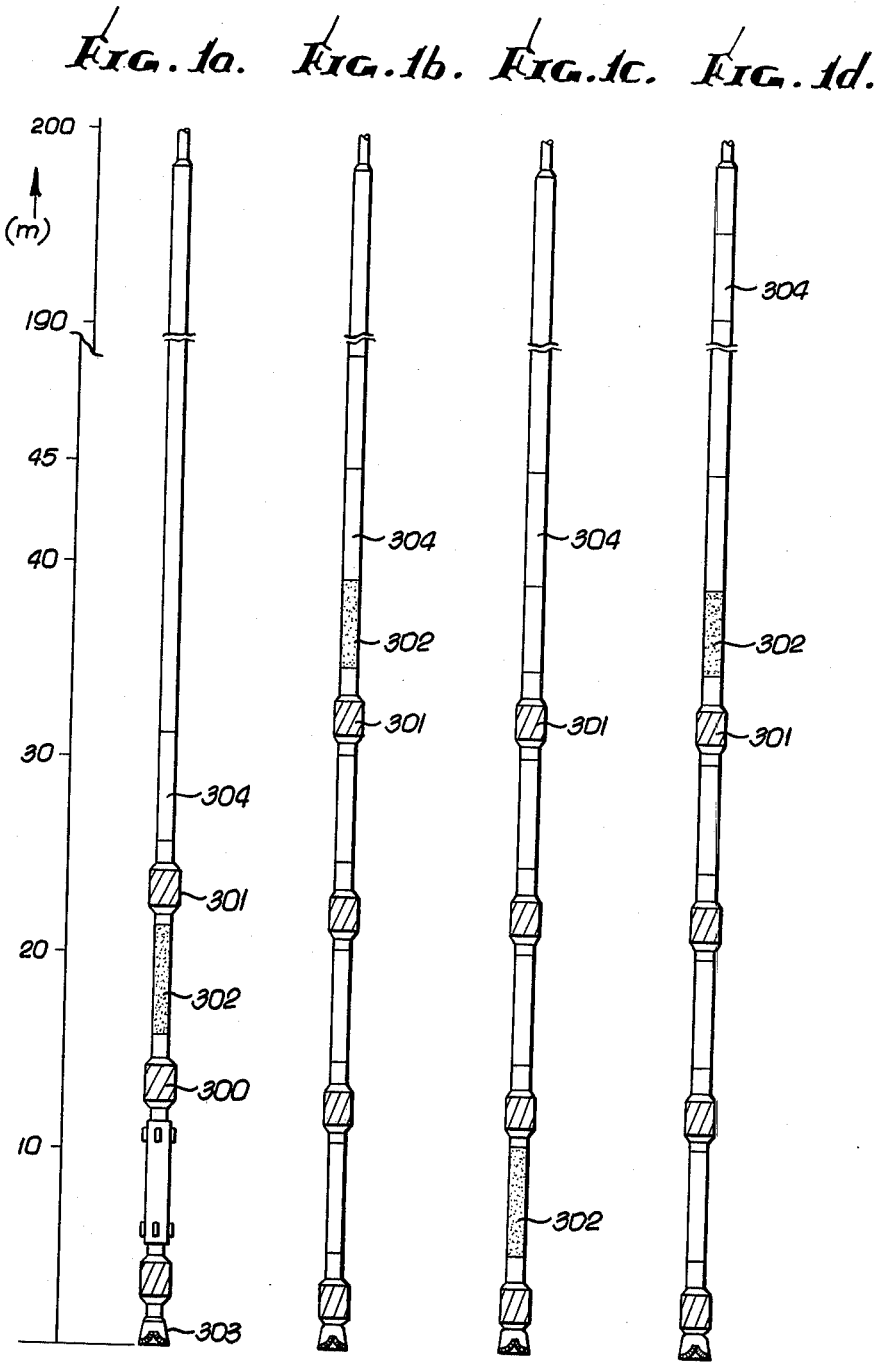

In FIG. 1, the ordinate (*m*) represents the length of the represented partial regions of the drill string which extend upward in any desired length. In the drilling string 1*a* two stabilizers 300,301 are disclosed, with a shock absorber 302 between them, a drill bit 303 being secured to the lower end of the drilling string. Directly above the top stabilizer 301, hammer jars 304 embodying the invention are installed in the drill stem assembly. In the drilling string 1*b* hammer jars 304 are installed in the drill stem assembly directly adjoining the shock absorber 302, which is arranged a short distance directly above the top stabilizer 301. In drilling string 1*c*, the shock absorber 302 is arranged directly above the drill bit 303, while the hammer jars 304 are again installed in the drill stem assembly above the uppermost stabilizer 301. In drilling string 1*d*, the hammer jars 304 are arranged in the upper end region of the drill stem assembly, a considerable distance from its stabilized portion, while the shock absorber 302 is located immediately above the top stabilizer 301. Fig. 1 shows that the hammer jars 304 according to the invention can be installed at any point required in the drill string. Beyond that, the hammer jars can also be installed at any point of the drilling string above the regions represented in FIG. 1.

Figure 2:
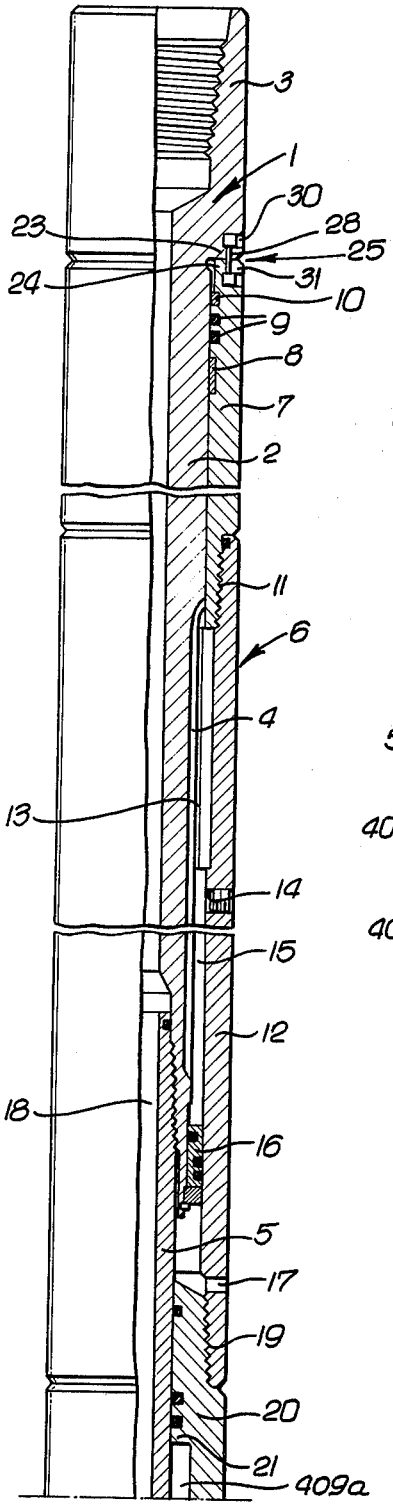
Figure 2A:
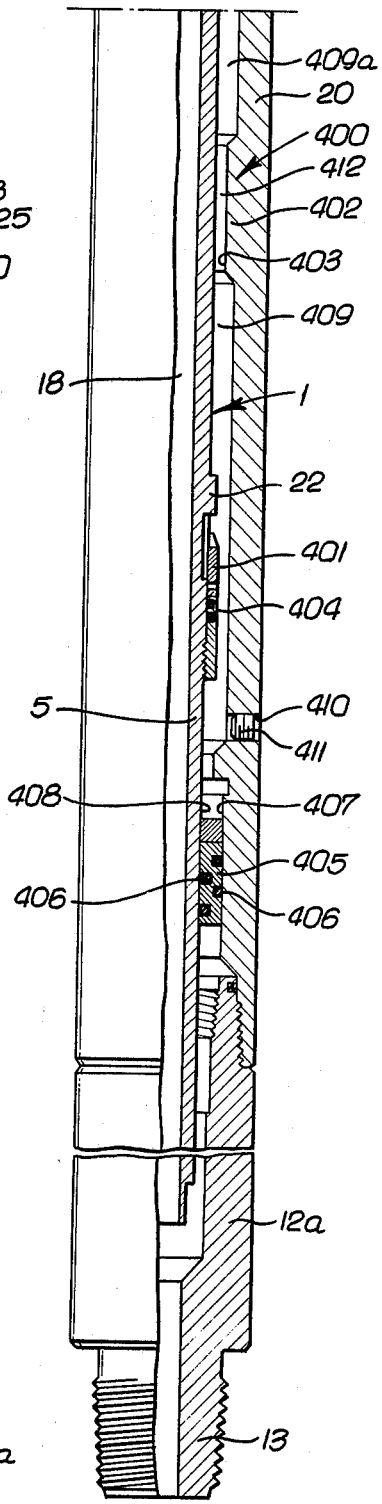

The hydraulic jars comprises, according to the embodiment of FIGS. 2 and 2*a*, an inner pipe body 1 whose upper part 2 is provided at its upper end with a threaded box 3 for connection of the jars to the adjacent part of a drilling string above it. Axially extending splines 4 are provided on the circumference of the upper part 2 of the inner pipe body 1. At its bottom end, the inner pipe 2 is secured to a central part 5 of the inner pipe body 1.

The upper part of the outer pipe body 6 includes a packing sleeve 7 having a guide ring 8 on its inner circumference, carrying two spaced sealing rings 9 and a stripper 10, which bear on the outer circumference of the upper part 2 of the inner pipe body 1. The packing sleeve 7 has a threaded connection 11 for securing it to a central pipe portion 12 of the outer pipe body 6, which has axial splines 13 of shorter length than the splines 4, meshing with the splines 4 of the inner pipe body. The splines or keys 13 permit transmission of the torque between the inner pipe body 1 and the outer pipe body 6, the greater axial length of the splines 4 of the inner pipe 1 permitting upward and downward movement of the pipe 1 relative to the outer pipe body 6. Lubricant can be introduced through an inlet hole 14 in the pipe portion 12 into the annular space 15 formed between the upper part 2 of the inner pipe body 1 and the portion 12 of the outer pipe body 6, after which the hole is closed by a suitable plug. The annular space is closed at the bottom by a compensating piston 16 subject to the drilling mud surrounding the pipe 12 which can flow through a port 17 in both directions. The drill mud passes through the central bore 18 of the inner pipe body 1 and through the bit, rising in the annular space formed between the drilling string and the borehole wall.

The central pipe portion 12 is threadedly connected at 19 to a pressure pipe 20 which has a shoulder 21 acting as an anvil engageable by a percussion piston or hammer 22 of the inner pipe body 1. The central pipe portion 12 has its lower end threadedly connected to a bottom sub 12*a* that has a threaded pin 13 adapted to be secured to an adjoining box portion of a drill collar or drill pipe (not shown). The portion 12 has an inwardly directed valve receiving section 400 through which the percussion piston 22 can pass, as described hereinbelow, as well as a valve sleeve 401 slidably mounted on the central part 5 and also adapted to pass through a restricted annular portion 402 of the pipe 20 with a relatively small clearance, so as to constitute an annular orifice in conjunction with the inner wall 403 of the valve receiving section. Downward movement of this valve sleeve along the central part 5 is limited by its engagement with a valve set 404 appropriately secured to the central part 5. This central part also extends downwardly through an annular compensating piston 405 which carries suitable seal rings 406 thereon slidably sealing against the inner wall 407 of the pressure pipe 20 and also against the periphery 408 of the central part 5. The annular space 409 between the inner central part 5 and the pressure pipe 20 constitutes a chamber in which a suitable lubricant is contained, this lubricant being introduced into the chamber through a suitable port 410 closed by a plug 411. The pressure of the drilling mud or other fluid passing downwardly through the inner pipe 2, 5 can enter the annular space between the inner and outer members 5, 20, and below the compensating piston 405, to transfer the drilling mud pressure to the lubricant in the chamber 409.

Assuming the inner pipe member 1 to be free to move longitudinally within the outer member 6 and the drilling string to be stuck in the well bore below the location of the jar, an upward strain can be taken on the drill string which will move the inner pipe body structure 1 upwardly until the hammer 22 and valve sleeve 401 pass into the annular region 412 within the valve fitting section 402. When the valve sleeve enters the valve fitting section, further upward movement of the inner body 1 within the outer body 6 is resisted, inasmuch as the lubricant in the chamber above the valve sleeve can only by-pass downwardly through the annular orifice around the valve sleeve. A sufficient upward pull is taken on the drill string and the inner body structure to move the valve sleeve through the valve fitting section, but such movement is relatively slow inasmuch as it is necessary for the lubricant in the chamber above the valve sleeve to by-pass through the annular orifice. Accordingly, a preselected tensile pull is taken on the drilling string and on the inner body 1, the valve sleeve moving upwardly along the valve fitting section until it enters the enlarged portion 409*a* of the chamber above the valve fitting section, which allows the hydraulic fluid above the valve fitting section to readily by-pass the valve sleeve, causing the drill string to accelerate rapidly in proportion to the amount of the tensile pull thereon, causing the hammer 22 to impact against the anvil shoulder 21 and deliver a jarring blow to the outer member 6.

In the event a downward blow is to be imparted on the drill string or drill collar below the hydraulic jar, it is merely necessary to lower the drilling string and the inner body member 1 to cause the downwardly facing shoulder 23 on the inner member to strike a blow against the upper end or shoulder 24 of the sleeve 7, this blow being delivered through the pressure pipe 20 and sub 12a to the drill collar or drill pipe therebelow.

After the upward jarring action has taken place, additional impacting of the hammer 22 against the anvil 21 can occur as a result of first lowering the drill string and inner body structure 1 within the outer body structure 6, and then taking a pull on the drilling string and inner body structure 1 to cause the sleeve valve 401 to move through the restricted valve fitting section 402. Similarly, repeated downward jarring can take place by elevating the inner body member 1 within the upper body member 6 and then allowing the drill string to move downwardly rapidly to cause the shoulder 23 to deliver a jarring blow against the upper end of the sleeve 7.

Details of the structure and mode operation of the floating sleeve valve and the annular orifice between it and the inner wall 403 of the restricted valve fitting section can be found in Canadian Pat. No. 931,136 and in U.S. Pat. No. 3,880,248. Such details are unnecessary to an understanding of the several embodiments of the present invention.

Figure 8:
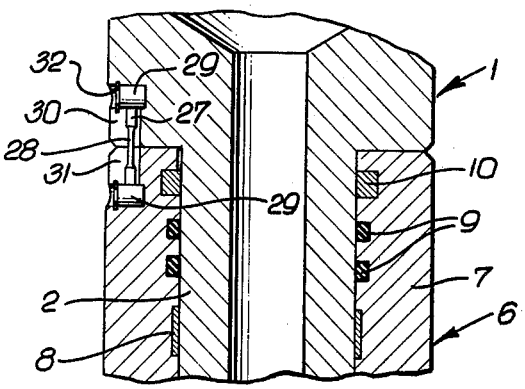
FIG. 8 shows an axial section through a portion of the hydraulic hammer jars according to the embodiment in FIG. 2, disclosing the locking device of the jars on a larger scale than in FIG. 2.
Figure 9:
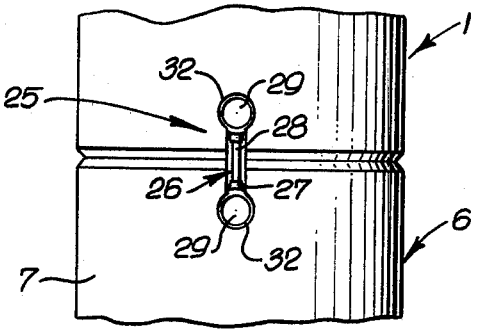
FIG. 9 shows a front view of the locking device illustrated in FIG. 8.
Figure 10:
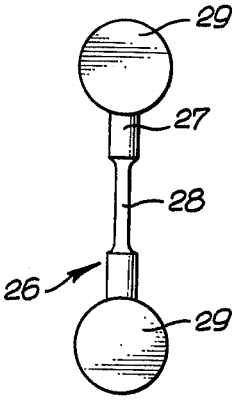
FIGS. 10 and 11 show front and side views, respectively, of the locking device on a larger scale than in FIGS. 8 and 9.
Figure 11:
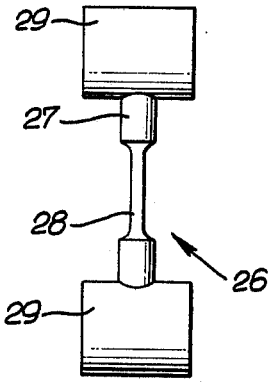

In the operating state represented in FIG. 2, in which the inner pipe body 1 and the outer pipe body 2 are telescoped, these are locked against axial relative movement by a locking device 25. The locking device 25 is formed in this embodiment by several, at least two, safety members 26 (FIGS. 8 and 9) which are angularly spaced uniformly from each other at the upper portion of the upper part 2 of the inner pipe body 1 and the adjacent end of the packing sleeve 7 of the outer pipe body 6. Each safety member 26 is formed by a bar body 27 with a central preset breakable region 28 and at its upper and lower ends with a head 29. The heads 29 of each bar body 27 can be inserted radially into a receiving recess 30 in the upper part 2 of the inner pipe body 1, and into a corresponding receiving opening 31 vertically aligned with the latter. The heads 29 are retained in place by a split snap ring 32.

Figure 3:
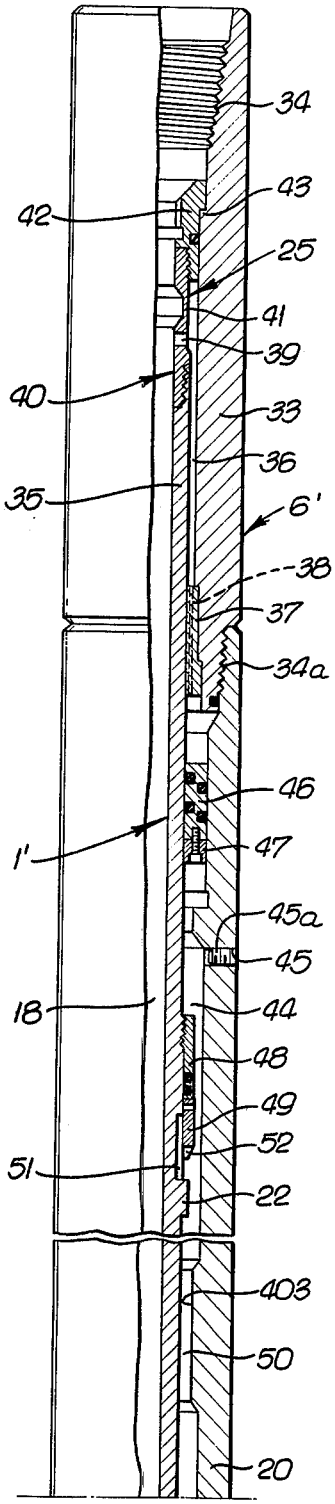

In the embodiment disclosed in FIG. 3, the hydraulic jars are installed in the drilling string in an inverted position relative to the arrangement shown in FIG. 2. In this arrangement, the downward blows are delivered by the percussion piston 22 by engaging shoulder 21 (not shown in FIG. 3) of the pressure pipe 20 of the outside pipe body 6'. The outer pipe body 6' is here provided with an upper connecting part 33 which has a female thread 34 for connection of the jars with the part of the drilling string above it. The pressure pipe 20 is threadedly connected at 34*a* with the connecting part 33, which forms an annular space 36 with the upper part 35 of the inner pipe body 1', which is closed at its underside by a guide ring 37, but which has a passageway 38 for the passage of a scavenging medium, which has access to the annular space.

Openings 39 are provided in a sleeve 40 which has a preset breaking point 41 forming the locking device 25, whose bottom end is secured to the upper part 35 of the inner pipe body 1', and whose top end is secured to a transition piece 42 which bears on a counter-shoulder 43 of the connecting part 33 of the outer pipe body 6'.

For performing downward blows in the embodiment shown in FIG. 3 by means of the percussion piston 22, an annular space 44 is provided between the upper part 35 of the inner pipe body 1' and the pressure pipe 20 of the outer pipe body 6', which can be filled with a pressure medium through a fill hole 45 that can be closed by a suitable screw plug 45*a*. At the top, the annular space 44 is closed by a compensating piston 46 to which a reinforcing ring 47 is attached, the piston being acted on by the pressure medium in the space 44. A valve seat ring 48 is located in the annular space 44 and secured to the pipe 1', a valve ring 49 being shiftable on the body. The ring-shaped precussion piston or hammer 22 on the upper part of 35 the inner pipe body 1' is disposed below the valve ring. The annular space 44 has a restricted region 50 of a smaller diameter through which the hammer 22 and valve 49 move, in a known manner, when the inner pipe body 1' and the outer pipe body 6' move apart, so that the surrounding pressure medium is forced to flow through a narrow ring slot or annular orifice between the valve 49 and the pressure pipe wall 403 of the outer pipe body 6'. As soon as piston 22 and valve have passed relatively through the region 50 of the annular space 44, the drilling shaft, which is under tension, acts as a spring and anvil 21 (as in FIG. 2) delivers a heavy blow against the hammer 20 of the inner pipe body 1'. When the outer pipe 6' moves downwardly of the inner pipe 1', after the hammer blow has been delivered, the wall 403 engages the valve 49 and moves it downward from its seat 48, the pressure medium flowing around the valve ring 49 through by-pass channels 51 provided in the upper part 35 of the inner pipe body 1', which are then in communication with corresponding radial openings 52 of the valve ring 49.

In the operating state represented in FIG. 3, the inner pipe body 1' and the outer pipe body 6' are initially locked by the safety sleeve 40 in their telescoped position. The taking of a sufficient upward strain on the outer body 6' by the drilling string disrupts the sleeve at its weak section 41, permitting the inner and outer body members 1', 6' to move longitudinally with respect to each other.

Figure 4:
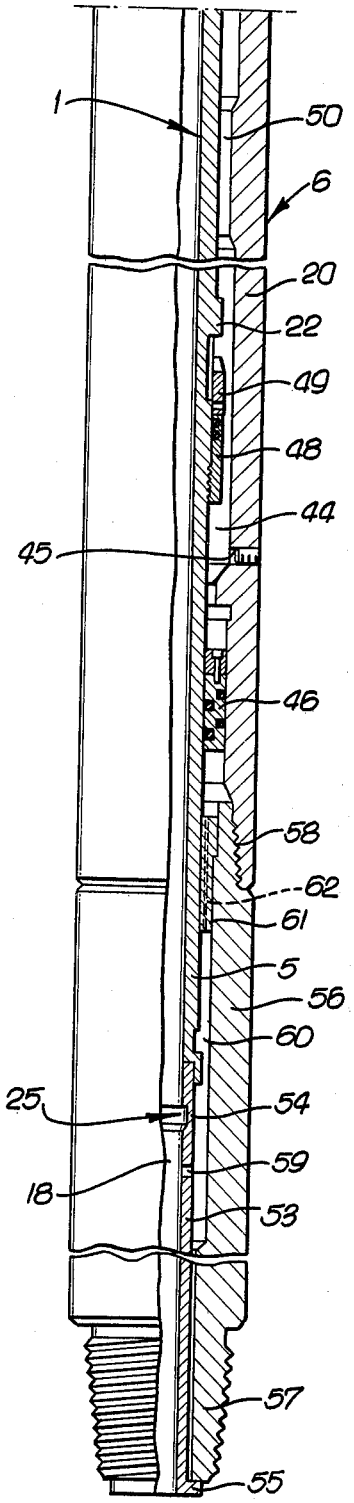

The embodiment shown in FIG. 4 can be considered as a bottom extension of the embodiment illustrated in FIG. 2. Instead of the safety members 26 being designed as bar bodies in the upper portion of the inner pipe body 1, a safety sleeve 53, having a preset breaking point 54, forms the locking device 25, which locks the inner pipe body 1 and the outer pipe body 6 in their telescoped position. The safety sleeve 53 is secured at its upper end to the lower end of the central part 5 of the inner pipe body 1. It has a flange or abutment shoulder 55 disposed under the lower end of a connecting pin 57 provided with a male thread for connection with the drilling string below the jars. The pin forms the lower portion of an outer pipe section 56 threadedly secured at 58 to the pressure pipe 20 of the outer pipe body 6. An annular space 60 can be charged with a liquid medium flowing from the center passage 18 through one or several radial openings 59 in the safety sleeve 53, and is closed at its upper end by a guide ring 61 having passageways 62 for admitting the compensating fluid into the lower part of the annular space for action upon the piston 46. Since the jars perform upward blows by means of the percussion piston 22 in the arrangement disclosed in FIG. 2, the hydraulic fluid enters through the fill hole 45 to fill the annular space 44 in which the valve seat ring 48, the valve ring 49, the ring-shaped percussion piston 22 are located, the space 44 including the region 50 of reduced diameter. The hammer shoulder or anvil 21 of the pressure pipe 20 is above the restricted region 50.

Figure 5:
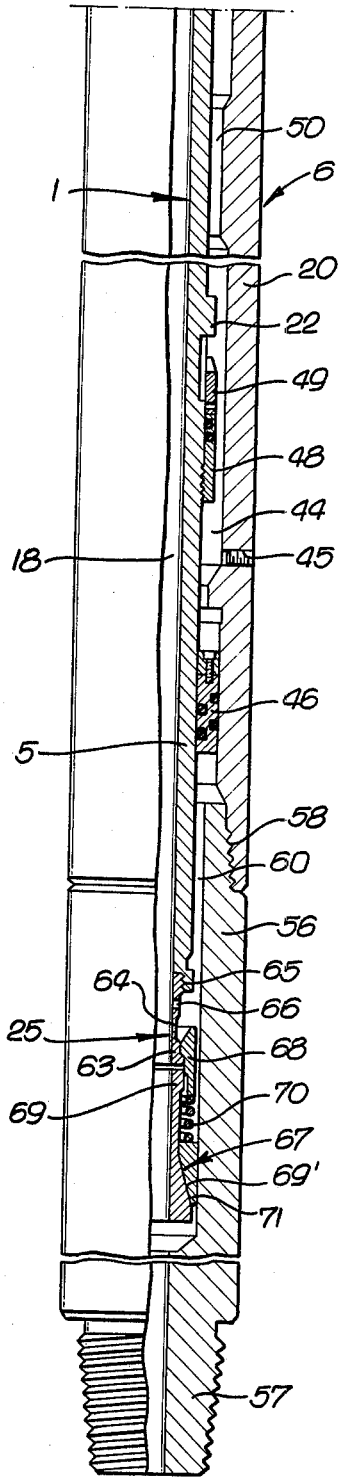

The embodiment shown in FIG. 5 differs from the FIG. 4 embodiment, particularly with regard to its assembled condition in the drilling string. It has a different design of locking device 25, which is formed in this embodiment of a safety sleeve 63 having a preset breaking region 64, the sleeve being secured to the lower end 65 of the lower part 5 of the inner pipe body 1, and being spaced from the outer pipe section to form an annular space 60. The safety sleeve 63 is likewise provided with one or several radial openings 66 for the passage of the compensating medium into the annular space 60 for action against the compensating piston 46. The locking of the inner pipe body 1 to the outer pipe body 6, in the represented telescopic position, is effected by a clamping wedge locking mechanism 67, which secures the lower end portion of the central part 5 and the lower connecting part 56 of the outer pipe body 6 against axial extension.

To this end, an intermediate ring 68 is secured to the lower part of the safety sleeve 63, and also to a separate abutment sleeve 69 extending coaxial of the safety sleeve 63, the sleeve 69 having a conical wedge surface 69' spaced below the intermediate ring 68. The abutment sleeve 69 is surrounded by a compression spring 70 which engages the lower pressure surface of the intermediate ring 68 and bears on the top side of clamping wedges 71 which are arranged between the wedge surface 69' of the abutment sleeve 69 and the inner surface of the connecting part 56 of the outer pipe body 6.

In the embodiments of FIGS. 2 to 5, if a drilling pipe string gets stuck in the borehole and must be loosened by blows, a predetermined pull, that is, an overload, which is introduced into the drilling string by pulling on the latter, is produced by the operating personnel at the drilling installation between the inner pipe body 1, 1' and the outer pipe body 6, 6', by which the safety members 26 and the safety sleeves 40, 53 and 63, respectively, are disrupted, so that the lock effected by the locking device is released and the inner and outer pipe bodies can move apart to perform upward or downward blows by means of the percussion piston 22 of the inner pipe body 1, 1' striking against the abutment shoulder 21 of the outer pipe body 6, 6'. Naturally, a corresponding locking of the inner pipe body 1, 1' and of the outer pipe body 6, 6' can be effected again by using new safety members 26 or safety sleeves 40, 53 and 63 at the drilling installation, after the drill pipe string has been pulled from the well bore.

The embodiment shown in FIG. 6 differs from that of FIGS. 4 and 5, with regard to the representation and arrangement in the drilling string, merely by a different design of the locking device 25. For the provision of the locking device 25, an additional closed annular space 72 filled with pressure medium is provided, according to the embodiment in FIG. 6, in the lower portion of the jar between the central part 5 of the inner pipe body 1, which is extended in this embodiment down to the lower portion of the jars. The connecting part 56 of the outer pipe body 6 is closed at its bottom end by a ring-shaped piston 73 which bears with its end face remote from the annular space 72 on a stop ring 74 secured to the inner pipe body 1. The upper end of the annular space 72 above the piston 73 is closed by a gasket 75. The annular space 72 can communicate with the annulus surrounding the outer pipe body 6 through a pressure relief valve, generally designated 76. The pressure relief valve 76 opens only at a predetermined excess pressure of the pressure medium enclosed in the annular space 72, which is produced by the operating personnel at the drilling installation by pulling on the drilling string when the latter gets stuck in the borehole. As long as the pressure relief valve 76 is closed, axial relative movement of the inner pipe body 1 with regard to the outer pipe body 6 cannot occur since the pressure medium in the annular space 72 functions as a hydraulic lock. Only when the pressure relief valve 76 opens is a working stroke of the hammer jar, that is, a relative separating movement of the inner pipe body 1 with respect to the outer pipe body 6, possible by the resulting communication of the annular space 72 with the region surrounding the pipe 6. One or several radial openings 45, closed by suitable plugs, are provided in the pipe 20 for admitting fluid into the annular space 44 for action on the compensating piston 46. The piston 73 can also be subjected to the fluid medium in the central duct 18 through an annular slot formed between the stop ring 74 and the connecting part 56 of the outer pipe body 6, and thus takes over a compensating function at the same time.

In the modified embodiment of a hydraulic locking device 25 shown in FIG. 7, the bottom of the additional annular space 72 is filled with pressure medium and is closed by a ring-shaped piston 78 which bears on a stop ring 79 secured to the part 5 of the inner pipe body. Below piston 78, several radial openings 80 are provided in the pressure pipe 20 of the outer pipe body 6 for admission of external fluid into the space 72 for action against the underside of the piston 78. In the upper end region of the connecting part 56 of the outer pipe body 6 is arranged a gasket 81 between the latter and the outer circumference of the part 5 of the inner pipe body, the upper end of the annular space 72 above the piston 78 being closed by an axially displaceable, ring-shaped intermediate piston 82 which closes the lower end of the annular space 44 filled with pressure medium, the space 44 surrounding the percussion piston 22 and the valve ring 49 with its modified valve seat 48'. At 83 is shown a modified pressure relief valve, of which several, arranged uniformly around the circumference of the outer pipe body 6, can be provided according to FIG. 7. Pressure relief valve 83 has a housing part 84 projecting radially into the additional annular space 72 which forms a lower stop for the intermediate piston 82. After the pressure relief valve 83 has opened and a blow has been performed, the housing part 84 forms an upper stop for piston 78, just as the piston 73 bears on the upper shoulder 56' of the connecting part 56 of the outer pipe body 6, in the comparable state in the embodiment according to FIG. 6.

In the embodiments shown in FIGS. 6 and 7, the pull introduced by the operating personnel is transmitted from the inner pipe body 1, through the stop rings 74 and 79 to the pistons 73 and 78, respectively, so that a pressure increase is produced in the annular space 72 proportionally to its piston surface, which leads to the opening of the pressure relief valves 76 and 83, respectively, at a predetermined upper limiting pressure value. Due to the resulting communication of the annular space 72 with the region surrounding the jars, the hydraulic lock between the inner pipe body 1 and the outer pipe body 6 is released and the jars can perform a first working stroke for an upward blow, in the embodiments according to FIGS. 6 and 7, by means of the percussion piston 22 striking the anvil surface 21 (FIG. 2). During this first upward stroke of the inner pipe body 1 with regard to the outer pipe body 6, there is a certain damping action present to prevent sudden bursting of the present breaking point of a safety member or safety sleeve, which results in a gentle transition to the working stroke.

Figure 12:
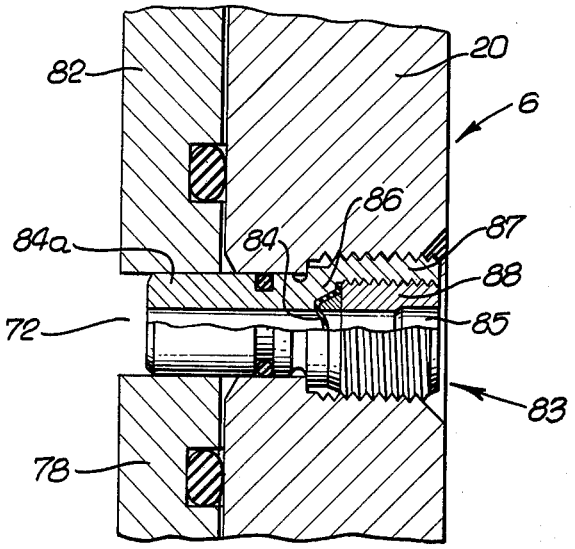

FIG. 12 shows an embodiment of the pressure relief valve 83 where it has a valve opening 85 closed by a rupturable disc 84. The rupturable disk 84 consists of a thin metal plate which ruptures at a predetermined pressure. Rupturable disk 84 rests on a retaining ring 86 and is secured in the valve housing 87 by means of a threaded sleeve 88 screwed into the valve housing 87. The valve housing 87 is, in turn, screwed by its threaded portion into a threaded bore of pressure pipe 20 and has the housing part **84*a* projecting radially into the annular space 72. While the rupturable disk 84 is represented in the unbroken state, the pistons 78 and 82 are shown (FIG. 12) in a position in which they bear on the housing part 84*a* of the pressure relief valve 83**.

Figure 13:
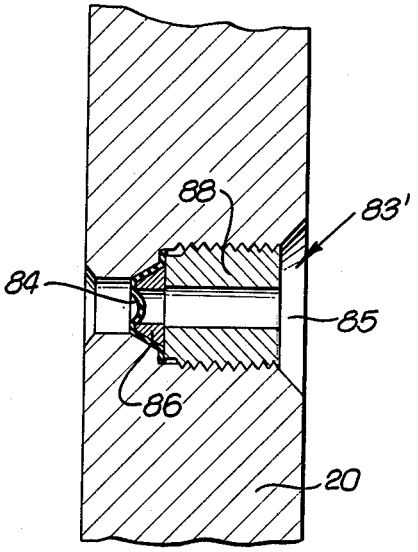

FIG. 13 shows a modified pressure relief valve 83', which likewise has a valve opening 85 closed by rupturable plate 84 but where the rupturable disk 84 resting on the retaining ring 86 is secured in place by means of a sleeve 88 threaded directly into a corresponding bore of the pressure pipe 20.

Figure 14:
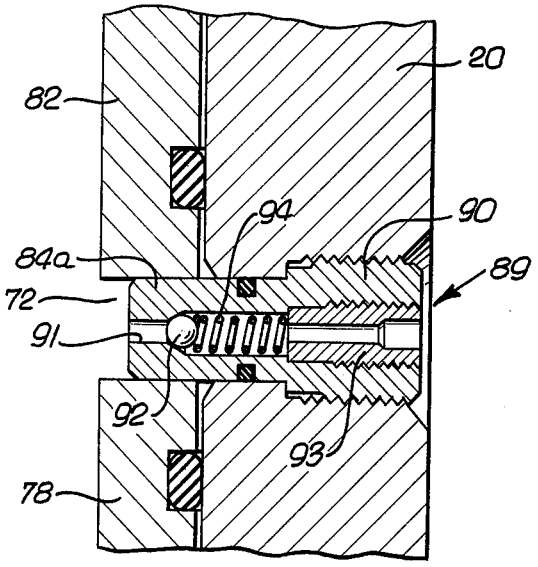

In the embodiment according to FIG. 14, the pressure relief valve is designed as a spring-loaded non-return valve 89, whose housing 90 is screwed into a bore of pressure pipe 20, just as in the embodiment according to FIG. 12, with the projecting housing part **84*a* serving as a stop for the pistons 78 and 82. The valve opening 91 is closable by means of a ball 92 against which a compressed spring 94 bears, put under compression by a pressure sleeve 93 screwed into the housing 90**.

Figure 15:
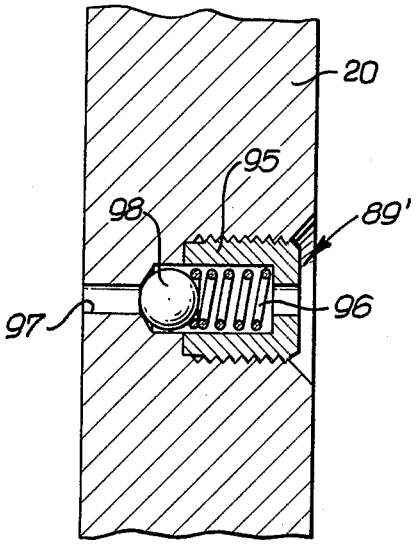

In the variant according to FIG. 15, the non-return valve 89' has a modified spring compression sleeve 95 screwed directly into a bore of the pressure pipe 20. A compression spring 96 is arranged in this embodiment between the inner end face of the sleeve 95 and a valve ball 98 closing the valve opening 97.

The pressure relief valve 83' and the non-return valve 89', respectively, can be used in the embodiment according to FIG. 7, in which the pressure relief valve, or several pressure relief valves distributed in a uniform angular relation over the circumference of the pressure pipe 20, are generally designated 83.

While the design of the pressure relief valves with rupturable disks has the advantage that the excess pressure necessary for opening the valves can be determined very accurately, the design as a spring-loaded non-return valve has the advantage that the flow of the surrounding fluid medium into the annular space 72, after the opening of the valves and the release of the lock, is prevented. Beyond that it offers the possibility of releasing the jars only for a limited extension movement between the inner and outer pipe bodies by allowing only a part of the pressure medium contained in the annular space 72 to flow through the valve with the overload necessary for opening the pressure relief valves by pulling on the drilling string at the drilling installation and restoring the lock again to prevent a further separating movement of inner and outer pipe bodies by pulling on the drilling string with overload. Instead, it is also possible to fill the annular space 72 only partly with the pressure medium, with the result that the jars permit a relative movement of the inner and outer pipe bodies, as is required for the imposition of blows imposed by the percussion piston 22 against the anvil 21. Such a design is of particular advantage if upwardly directed. Gravity dependent blows are to be exerted by moving the drilling string up and down to overcome any resistance in the borehole during the lowering of the drilling string, that is, when the jars are to be used as a buffer bar or a so-called bumper.

The foregoing detailed description of a number of embodiments does not exclude numerous possible variations in the design and arrangement of the locking device between the inner and outer pipe bodies. Thus, for example, an embodiment of the jars can be provided by inverting the FIG. 2 embodiment, with an outer pipe body connected to the upper part of the drilling string, the locking device being similar to the embodiment in FIG. 2, and to arrange it correspondingly between the lower connecting end of the inner pipe body and the lower part of the outer pipe body. Furthermore, a hydraulic design of the locking device can be provided as a variation of the embodiments according to FIGS. 6 and 7, the outer pipe body being connected with the upper part of the drilling string and the inner pipe body connected with the lower part of the drilling string. In a variant of the embodiment according to FIG. 3, such jars can also be designed for the performance of upward blows by inverting the jars, in which case it suffices principally to design the hammer system as it is represented in the embodiments of FIGS. 4 and 5 and FIGS. 6 and 7, respectively.

Finally, it is also possible in a mechanical locking device to arrange the locks and the jars not only in the fully retracted position, but also in an intermediate position in which the inner and outer pipe bodies are displaceable to a limited extent between a fully telescoped and partly separated position. This is possible, for example, by extending the bar body 28 (FIG. 2) and designing the openings 30, 31 as axial slots, or by extending the safety sleeve 53 (FIG. 4), or by extending the safety sleeves 40 (FIG. 3) and 67 (FIG. 5), respectively, and securing them on the inner or outer pipe body by means of a limited sliding guide.

I claim:

1. Hydraulic hammer jars for deep well drilling, which can be installed as a component in the drilling string; an outer pipe body and an inner pipe body within said outer body and defining therewith an annular space adapted to be filled with a pressure medium, said outer pipe body and said inner pipe body being telescopically related to each other and extensible and contractable axially with respect to each other, an inner percussion piston on one of said bodies acting as a hammer, an anvil on the other of said bodies adapted to be struck by said hammer upon separating movement between said bodies, and a releasable locking device operatively associated with said bodies to limit relative axial separating movement between said bodies, said locking device including means released in response to a predetermined axial pull being taken on said inner and outer pipe bodies.

2. Hammer jars as defined in claim 1; said locking device comprising one or more safety members connecting the inner pipe body with the outer pipe body.

3. Hammer jars as defined in claim 2; said inner pipe body having means for connecting said inner pipe body with the drilling string thereabove, said outer pipe body having means for connecting said outer body with the drilling string therebelow, said outer inner pipe body having said anvil, said hammer being on said inner body for striking said anvil, said one or more safety members being secured to the upper portions of said inner and outer pipe bodies.

4. Hammer jars as defined in claim 2; said one or more safety members comprising bar bodies having upper and lower heads, said bodies having recesses opening to the exterior of said pipe bodies and receiving said heads for connecting said bodies together.

5. Hammer jars as defined in claim 3; said one or more members comprising bar bodies having upper and lower heads, said bodies having recesses opening to the exterior of said pipe bodies and receiving said heads for connecting said bodies together.

6. Hammer jars as defined in claim 2; said one or more safety elements comprising a safety sleeve having an upper connector secured to the lower end portion of said inner pipe body, said sleeve having an abutment shoulder extending under said outer pipe body.

7. Hammer jars as defined in claim 2; said one or more safety members comprising a safety sleeve device having an upper connector secured to the lower end portion of said inner pipe body, said outer pipe body surrounding said lower end portion, and a wedge locking mechanism securing the lower end portion of said safety sleeve device to said outer pipe body.

8. Hammer jars as defined in claim 7; and a compression spring bearing at its upper end against the portion of said safety sleeve device and at its lower bottom end against the top side of the wedge locking mechanism.

9. Hammer jars as defined in claim 2; said outer pipe body having means for connecting said outer pipe body to the drilling string thereabove, said inner pipe body having means for connecting said inner body to the drilling string therebelow, said one or more safety members comprising a safety sleeve having an upper end portion supported at the upper portion of the outer pipe body, and a lower end connected to an upper part of said inner pipe body.

10. Hammer jars as defined in claim 1; said inner and outer pipe bodies defining another normally closed annular space adapted to be filled with a pressure medium and which is separate from said first mentioned annular space, and a pressure relief valve communicating with said another annular space and the exterior of said outer pipe body, said valve opening at a predetermined excess pressure of the pressure medium enclosed in said another annular space.

11. Hammer jars as defined in claim 10; said pressure relief valve having a valve opening closed by a disk rupturable by fluid under pressure.

12. Hammer jars as defined in claim 10; said pressure relief valve having a check valve element, and a spring exerting a closing force on said element to maintain the element in valve closing position.

13. Hammer jars as defined in claim 10; said another annular space being closed at one end by a first piston and at its other end by an axially displaceable annular second piston, which also closes an end of said first-mentioned annular space.

14. Hammer jars as defined in claim 13; said valve having a portion projecting radially into said another annular space to form a stop for said first and second pistons.

* * * * *